United States Patent [19]

Kent, Jr.

[11] 3,973,341

[45] Aug. 10, 1976

[54] INFORMATION DISPLAY SYSTEM

[76] Inventor: Marc T. Kent, Jr., 820 Soundview Drive, Mamaroneck, N.Y. 10543

[22] Filed: Oct. 14, 1975

[21] Appl. No.: 621,953

Related U.S. Application Data

[63] Continuation of Ser. No. 400,214, Sept. 24, 1973, abandoned.

[52] U.S. Cl. ..... 40/124.1

[51] Int. Cl.[2] ..... G09F 1/00

[58] Field of Search ..... 40/124.1, 125 H, 125 R, 40/125 F, 153, 152.1, 152.2, 11 A, 120, 125 G, 37, 39

[56] References Cited

UNITED STATES PATENTS

| | | | |
|---|---|---|---|
| 293,850 | 2/1884 | Carly | 40/39 |
| 3,108,696 | 10/1963 | Winner | 40/124.1 |
| 3,469,335 | 9/1969 | Leigh | 40/124.1 |

FOREIGN PATENTS OR APPLICATIONS

| | | | |
|---|---|---|---|
| 409,795 | 9/1969 | Australia | 40/124.1 |
| 1,536,340 | 7/1968 | France | 40/124.1 |

*Primary Examiner*—John F. Pitrell
*Attorney, Agent, or Firm*—Gipple & Hale

[57] ABSTRACT

A Unitary display device having front and rear display surfaces with major section and bendable minor section(s), where each of the sections are separable by a line of weakening therebetween. A bendable length of wire is fixedly disposed interior of the device and serves to provide rigidity to the entire device. A section of the wire is caused to bend in concert with the minor section(s) of the device, as it is bent along the line of weakening, to thusly form a base upon which the major section can be positioned. A plurality of movably sectors, for example, concentric semicircular, are provided in the major section and are urged away from the plane of such major section, to create a three-dimensional information display, the sectors serve to provide a combined information visual display on both front and rear surfaces.

1 Claim, 3 Drawing Figures

INFORMATION DISPLAY SYSTEM

Figure 1A:
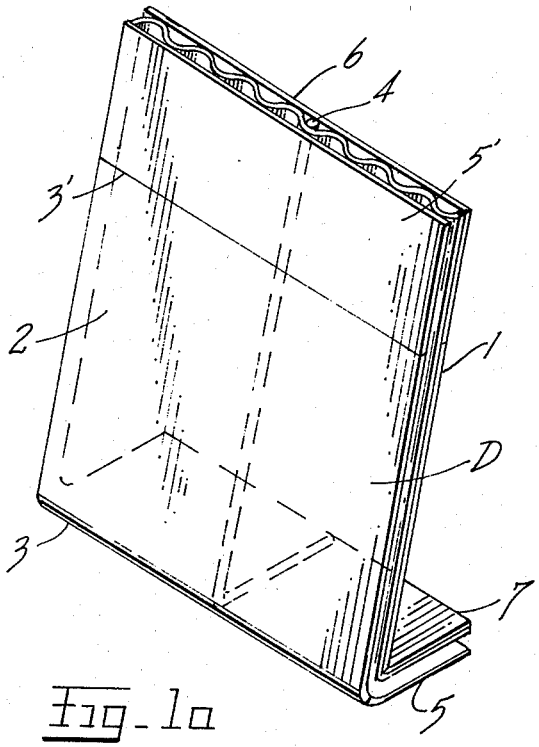

This is a continuation of U.S. patent application Ser. No. 400,214 filed Sept. 24, 1973, now abandoned.

The present invention is directed to a display device for presenting indicia on one or more surfaces. More particularly, the present invention is directed to a display device having as an integral part thereof means by which a major portion of the device may be oriented so as to form a base for the display device to be self-erecting.

The use of display devices or signs for advertising purposes at commercial establishments is well established. More particularly, such signs have commonly had as an integral part thereof, means usually located on the opposite surface of the display surface for positioning such signs in a manner so that they are able to be placed at select locations in an establishment. In this connection, it is common place that such signs be either hung by a fastening means, i.e. adhesive, hook or string and associated eyelet arrangement for vertically disposing the sign or the display device. In other instances it has been common place to employ a foldable type of pedestal arrangement which would enable the sign to be positioned on a platform or an easel for display purposes. The aforementioned are intended to illustrate several different types of means by which display devices are positionable. In each case, however, the type of structure employed resulted in a bulky display device which often times tended to increase the overall cost to the end user because of the necessary die cutting; base members; pedestals, etc. for manufacturing the complete display device.

The advertising field or display craft has always sought more simple and yet efficient assemblies by which such display devices could be manufactured and ultimately made available so that it would enable position at select locations. This is particularly important for maximum viewing exposure by the consuming public while at the same time, being inexpensively manufactured. Essential to this arrangement is the ability to form a stable platform or base by which such display device could be positioned.

Accordingly, it is the main object of the present invention to overcome the defects of the prior art.

A further object of the present invention is to produce a simple less costly and highly efficient integral display device with an associated base portion for selectively positioning such device.

A further object of the present invention is to provide an integral display device containing means which permits a portion of such device to be folded so as to provide a platform or base by which the major portion of the device can selectively be positioned.

Still a further object of the present invention is to provide an integral display device having a foldable base portion together with display surfaces on two sides where such surfaces are provided with movable portions.

Another object is to provide a display device having a first surface capable of being extended in more than on a one plane so as to effectively combine information from a first plane into a second plane.

A further object of the present invention is to provide a simulated three-dimensional display device where select cut-out portion or portions can be positioned opposite from a first plane into a second plane and where segments of each are in turn oppositely rotated with respect to one another and to create a simulated three-dimensional effect.

Other objects and intentions of the present invention will be more readily understood with respect to the associated drawings.

FIG. 1*a* shows a perspective view of the basic embodiment of the present invention.

Figure 1B:
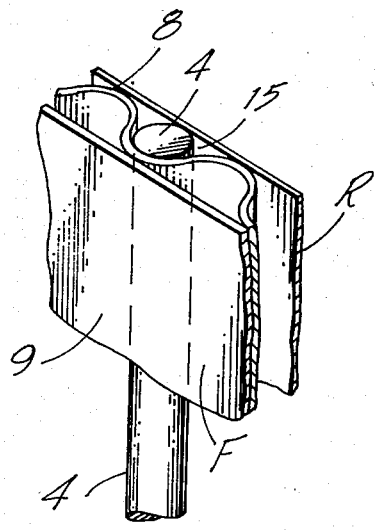

FIG. 1*b* is an enlarged partial view of FIG. 1*a*.

Figure 2:
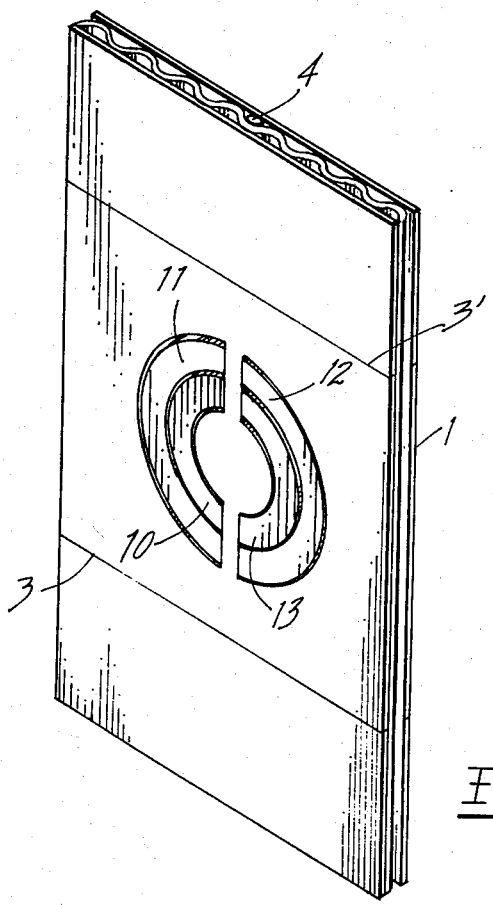

FIG. 2 illustrates another embodiment of the present invention making use of movable sectors.

The essential features of the present invention includes a unitary display device having at least a single information surface divisible into two distinct portions, said device including: a major portion; a minor portion; a line of separation formed between said major portion and said minor portion, permitting said minor portion to be folded at an angle with respect to the plane of said major portion; and a bendable elongated member disposed internal of said display device, extending for the entire length thereof.

Also within the scope of the invention is another embodiment of the display device having one or more information display surfaces where a major portion includes a sector or a plurality of concentric predefined sectors disposed about a fixed body, said fixed body is provided with an axial projection extending in the plane of an information surface, to thereby permit said sector or sectors to be moved about said axial projection.

The inventive device furthermore includes a major portion provided with one or more cut-out sectors having a predefined orientation with respect to the vertical and horizontal axis of said major portion; and when a plurality of sectors are employed, each of said sectors being contiguous with respect to one another and disposed about generally a fixed body having a segment extending therefrom serving as an axis of rotation for each of said respective sectors.

In accordance with the embodiment shown in FIG. 1a, the display device 1 includes a total information display surface 2 having associated therewith a line of weakening 3 located approximately 3/4 of the way down from the top edge 6 of the display device 1. This line of weakening 3 extends across the lower portion in a line parallel to the horizontal axis of display 1. An additional line of weakening 3' is located about ¾ of the way up from edge 7 and functions in a manner similar to line of weakening 3. This embodiment serves to provide an alternate device positioning as hereinafter described. Integrally mounted in such device 1 and extending for its entire length, is a centrally disposed malleable wire member 4 which serves to provide rigidity, as well as, strength to the device 1.

In the preferred embodiment, when it is desired to form a base on the device 1, such device 1 is sufficiently bent along the line of weakening 3 in order to define the slope and amount of device information exposure for the unbent or major portion D. This bending action in turn urges the section or length of wire extending at 3 to bend at that point and thus the minor section 5 is imparted with sufficient stability for positioning on a flat surface. By controlling the amount of inline of device 1, with respect to the principal axis of the surface upon which such display device rests, it is possible to achieve different effects. If for one reason or another, it is not desired to employ such display device 1 in the aforementioned manner, a suitable means such as: an eyelet with associated string, are provided permitting the device 1 to be positioned in the fully extended manner.

It has been found for example, that the inventive device operates successfully with a corrugated cardboard type of internal material 8 with a suitable exterior layer 9 of sized finishing paper. (See FIG. 1*b*). Such arrangement provides the necessary type of cross sectional configuration and imparts sufficient rigidity for display devices of this type. Also essential to this invention is the fact that the centrally disposed wire 4 must be sufficiently malleable to be flexed without failure, while at the same time imparting enough rigidity to the entire display device 1 to allow for reasonable number of pre-oriented positions without wire failure. The minor portion 5 of the display device (when not folded away) provides additional message area for advertising.

It remains for the integral wire 4 in combination with the foldable portion 5 to provide the basis by which the display device is able to be positioned. The wire 4 itself is a conventional steel wire, i.e. circular or flat in cross-section, that is physically placed into the corrugated interior surface 8 of the display device 1 and is forced through a designated fluted section 15. Additionally, it may be glued in place so that it does not in any manner shift position. The ease by which the sign is able to be positioned almost on any flat surface provides for the high degree of utility, a vital factor for the display devices of this type. The line of weakening 3 above the portion 5 of display device 1 is achieved by scoring the rear and front surface of the device 1 with conventional means. Hence, for example, the lower section of the device can be flexed and positioned in accordance with the desired viewing angle.

FIG. 2 of the present invention includes an alternate embodiment making use of one or more concentric circular sectors 10, 11, 12, 13 which are moveable in a plane perpendicular to the front and rear surfaces of the display device 1. Such sector or sectors, are described as semicircular purely for illustrative purposes and other shapes such as, but not limited to circles, semi-circles, squares, diamonds, rectangles may be employed. The sectors 10, 11, 12, 13 are dispised in the center of device 1 about a predefined non-rotatable member 14 so as to create a three-dimensional combined, rear R and front F information arrangement as the sectors are rotated. This is achieved by moving the sectors in planes opposite to one another so as to provide selective additional display information from one or the other viewing surfaces of the display device 1. For example, by rotating section 10 onto the front surface F, it is possible to create a visual display where information from surface F is combined with the existing information on surface R. Therefore, as the need arises, the message can be varied from time to time and also easily returned to its original position. Additionally, this embodiment makes use of the centrally disposed wire 4 and a line of weakening 3 as previously described, enabling such device 1 to be positioned at an angle with respect to a principal axis, as hereinbefore described. By means of moving such sectors 10, 11, 12, 13, it is furthermore possible to create a three-dimensional or multi-planar visual effect so as to further enhance the display device 1.

As with the aforementioned embodiment shown in FIG. 1a, the embodiment of FIG. 2 can be disposed in a stationary or a free standing position by having a fastening means provided at the upper portion of the device. Of course, the number and shape of sectors 10, 11, 12, 13 and the manner by which each sector relates to one another can be varied depending upon the special effect desired. For example, the inner set of sectors 10 and 12 can be urged to move in a plane perpendicular to the rear of surface of the display device 1, whereas, the other sectors 11 and 13 can be urged to move in a plane perpendicular to the front surface at the display device 1. As a result, alternate and oppositely directed sectors are thereby formed.

In accordance with FIG. 1a, it should be understood, that the device 1 can be employed in a manner where the two portions 5, 5′ are formed and defined by associated lines of weakening 3, 3′ each disposed at a prescribed distance from the respective ends 6 and 7. Accordingly, with this embodiment the invention may be employed for the display of information in the horizontal plane. As the portions 5, 5′ are folded in the hereinbefore described manner, the display device is caused to rest on an edge, whereby 5, 5′ aids in providing the requisite support for the device.

It will be apparent to those skilled in the art from the preceding description, that certain changes may be made in the above invention without departing from the scope of the invention. It is intended that the descriptive matter above shall be interpreted as illustrative and in no way limiting, since all equivalents within the scope of the disclosure may be substituted and such substitution is intended.

What is claimed is:

1. A one piece knock-down display device adapted to be positioned as a stand-up display comprising a display section provided with a plurality of cooperatively associated information display portions; a base section connected to said display section; a line of separation disposed between said display section and said base section, enabling the formation of a stable base by bending said base section along said line; a bendable elongated support member positioned within said display device and extending substantially the entire length thereof, said support member being bendable in concert with said device; said display section being further defined by, a central fixed positioned first information display portion; a second information display portion spaced away from and surrounding said first information display portion, in a plane identical to said first information display portion; a pair of intermediary members formed as a continuation of said first and second information display portions disposed at opposite points 180° apart from one another along the principle axis of said display section, said intermediary members being adapted to fix the planar and spatial relationship of said first and second information display portions respectively; and a third information display portion in the form of individually positionable information sectors concentrically disposed about said first information display portion, each information sector being separably bendable about lines of weakening running from each of said intermediary members allowing said sector to be positioned out of the plane of said first and second information display portions, and said intermediary members.

* * * * *